United States Patent [19]

Dreher

[11] 3,986,611

[45] Oct. 19, 1976

[54] CLING FILM OVERWRAP FOR PALLETIZED ARTICLES

[75] Inventor: Donald H. Dreher, Vernon, N.J.

[73] Assignee: Union Carbide Corporation, New York, N.Y.

[22] Filed: June 9, 1975

[21] Appl. No.: 585,036

Related U.S. Application Data

[63] Continuation of Ser. No. 376,963, July 6, 1973, abandoned.

[52] U.S. Cl. ..... 206/386; 206/45.33; 206/497; 229/3.5 R

[51] Int. Cl.[2] ..... B65D 19/38; B65D 65/16

[58] Field of Search ..... 206/386, 499, 45.33, 206/83.5; 229/DIG. 12, 3.5 R, 87 R; 428/174, 409

[56] References Cited

UNITED STATES PATENTS

| | | | |
|---|---|---|---|
| 2,679,969 | 6/1954 | Richter | 229/3.5 R |
| 3,423,274 | 1/1969 | Lahm et al. | 428/409 |
| 3,501,363 | 3/1970 | Kirkpatrick et al. | 428/174 |
| 3,508,375 | 4/1970 | Myers | 53/30 |
| 3,589,510 | 6/1971 | Begnaud et al. | 206/497 |
| 3,626,654 | 12/1971 | Hoffler et al. | 53/26 |
| 3,667,598 | 6/1972 | Zelnick et al. | 206/386 |
| 3,710,539 | 1/1973 | Cothran et al. | 206/497 |

*Primary Examiner*—William Price
*Assistant Examiner*—Bruce H. Bernstein
*Attorney, Agent, or Firm*—Cornelius F. O'Brien

[57] ABSTRACT

Pallet supporting an array of articles which are vertically enveloped by at least two substantially superimposed tensioned wraps of a flexible cling film web and to a method of enveloping said array of palletized articles.

9 Claims, 3 Drawing Figures

CLING FILM OVERWRAP FOR PALLETIZED ARTICLES

This is a continuation of application Ser. No. 376,963 filed July, 6, 1973, now abandoned.

FIELD OF THE INVENTION

The invention relates to an article-loaded pallet having at least two overwrapped tensioned layers of a flexible cling film encircling the vertical outer periphery of the articles and to a method for applying the cling film to the article-loaded pallet.

BACKGROUND OF THE INVENTION

Articles or packages of merchandise are conventionally loaded on pallets or pallet-like supports for storage or are secured on such pallets for transporting to various destinations within a warehouse or between warehouses. One method employed to secure individual packages or containers on a pallet is to bind them horizontally and vertically with metal bands or the like. Although this procedure is widely used, the packages or containers are not protected from inclement environments that may be encountered in their storage locality or during transit.

To remedy this shortcoming, it has been conventional to enclose article-loaded pallets with loosely fitting bags of heat-shrinkable plastic film, which when exposed to a suitable heat treatment will cause the film to shrink into conforming engagement with the articles. Although this approach can also be utilized to secure the articles on a pallet without the need for straps or bands, the machinery necessary for heating the film enclosed pallet is rather bulky and expensive to operate. In addition, this approach is limited to articles that are not susceptible to heat damage during the film shrinkage process.

Another process presently being used is to tension wrap polyethylene stretch film around the articles until at least a thickness of several layers is achieved and then heat seal the trailing edge of the film to the underlying film wraps. This process requires a means for first securing the leading edge of the film to the article-loaded pallet and then heating means to secure the trailing edge of the film to an area on the underlying layers of film. Thus the heat treated area about the trailing edge is the only area that provides the sole means for securing the film to itself and containing the articles on the pallet. If the trailing edge comes loose, the film will be subject to immediate loss of tension and unwrapping.

Attempts have been made to use narrow width (12 inches) thermoplastic films containing cling agents to secure the top two or three layers of articles on a pallet by wrapping several layers of the film about each individual horizontal level where the articles abut. In order to utilize this securing method, the articles on the pallet have to be of uniform size so that a horizontal abutting line is provided between the top two layers of articles. In addition, a separate wrapping procedure has to be performed for securing the articles of each two adjacent layers. Thus in addition to requiring uniform article sizes, the wrapping procedure is prolonged since each wrapping procedure will only secure two adjacent layers of articles.

It is the primary object of this invention to provide an article-loaded pallet with a securing means that is easy to apply and which will provide stability for the articles without the need for straps or bands.

Another object of this invention is to provide a method whereby clingable film, having a width equal to at least the height of an article-loaded pallet, can be vertically wrapped about the article-loaded pallet so that in addition to securing the articles, the film will protect the articles from dust, moisture and scuff during storage and transit.

Another object is to provide a method for wrapping article-loaded pallets with flexible clingable film without the need of heat sealing means or film shrinking procedures.

Another object is to provide a cling film encased article-loaded pallet whereby individual articles can be removed without loss of securement for the remaining articles.

Another object is to provide a cling film encased article-loaded pallet whereby the articles can be visually detected and viewed at all times.

SUMMARY OF THE INVENTION

The invention relates to an article-loaded pallet wherein the articles are at least vertically encased with at least two substantially superimposed tensioned wraps of a flexible cling flim. The invention also relates to a method of tension enveloping a plurality of articles supported on a pallet with a flexible cling film, said method comprising the steps of:

a. loading a pallet with a plurality of articles into a predetermined array;
b. providing a supply of a flexible cling film web;
c. securing a first end of said web to a selected first surface on said array;
d. feeding said web from said supply and concurrently stretching said web along the first and successive selected surfaces about the vertical outer periphery of said array until said outer periphery of the array is enveloped with at least two substantially superimposed layers of cling film thereby producing a substantially monolithic film at least in areas of contact with said articles on the pallet;
e. severing the web from the supply thereby providing a second end of said web; and
f. adhering said second end to the underlying wrap of cling film web.

When the width of the cling film web is substantially at least the height of the array of articles, then step (d) above may be performed in two stages as follows:

d'. feeding said web from said supply and concurrently stretching said web along the first and successive selected surfaces about the vertical outer periphery of the array until the outer periphery of the array is enveloped with a layer of cling film; and
d''. superimposing and adhering at least one successive wrap of the cling film web to the underlying wrap thereby producing a substantially monolithic film at least in areas of contact with said articles on the pallet.

Articles, as used herein, are intended to mean cartons, containers, packages, solid or hollow discrete objects or the like.

A self-supporting flexible film possessing cling characteristics is a film that will cling strongly to itself and to other surfaces. Cling can be expressed as the energy in cm-gms required to peel a 3½ inch wide by 4 inch long cling film specimen from a glass plate when using the test procedure outlined in ASTM D903-49, titled "Test For Peel Strengths of Adhesives". Flexible film having a cling energy of between about 0.15 and about 0.4 cm-gm are suitable for use in this invention while flexible films having a cling energy of between about 0.2 and 0.3 cm-gm are preferable.

Thermoplastics, such as polyolefin films, as disclosed in U.S. Pat. No. 3,423,274 to W. J. Lahm et al, are an example of films exhibiting good cling characteristics and good handleability while being substantially transparent so that when used as a wrapping material, the object wrapped can be visually inspected. Unmodified polyolefin film may possess low slip characteristics but does not necessarily cling together as the term is used in this application. Such film must normally have cling additives incorporated to improve or regulate its cling characteristics. Cling additives are well known in the art and include such materials as the mono- and diglycerides of fat-forming fatty acids and mixtures thereof, as described in U.S. Pat. No. 3,048,263 to Sacks et al. These additives can be incorporated to various flexible films to yield a clingable film admirably suited for use in this invention. For example, U.S. Pat. No. 3,501,363 discloses a transparent self-supporting polyethylene film having cling additives of mono- and/or diglycerides of fat-forming fatty acids which have excellent cling characteristics and handleability properties. Other possible materials for use as adherent surface films include polyvinylidene chloride (PVDC), polyvinyl chloride (PVC), rubber hydrochloride and the like. Thus it is well known in the art how to fabricate flexible cling film having a balance between effective cling properties and good handleability.

The flexible cling films for use in this invention can range in thickness from about 0.25 mil (0.006 mm) to about 1.25 mils (0.031 mm) depending on the strength required for the particular application. Preferably, a film thickness of about 0.5 mil (0.0127 mm) is deemed suitable for most applications since any desired thickness can be achieved by wrapping as many layers of the film around the articles as necessary for the particular situation.

In the preferred embodiment of the invention, successive tension wraps of a thin cling film web, having a width equal to at least the height of the articles loaded on a pallet, are applied about the load perimeter of the article-loaded pallet to snug up the articles each to the other. The continuous film web which comprises at least two layers of overwrap, provides a like number of tensioned wrapped surfaces progressively adhering together into a monolithic structure due to the applied tension and the cling properties of the film. The outer wrap and terminal of the cling film secures and sustains itself under tension to the underlying wrap when it is wiped against the underwrap with a simple planishing pressure wipe. The width of the cling film web may overlap the top articles and also enclose at least a portion of the pallet platform. Where the pallet is a slip sheet, then the segment of the sheet intended to be grasped by loading means should not be enclosed with the film.

Preferably, at least four overwraps, such as of 0.5 mil cling film, should be applied to an article-loaded pallet so that by tightly stretching and concurrently progressively applying the wraps, the outermost wrap will be secured to the underlying wraps in a manner to further tighten the underlying plies of film about the articles. Furthermore, it is believed that this tension wrapping method provides a more uniform hoop tension to the articles and thus improves shipping security for a pallet load with less total film weight than can be attained by tension wrapping of non-cling film material.

Tension wrapping is intended to mean the wrapping of a film around articles loaded on a pallet under a force of at least about ⅓ lb. per inch of width of the film web and preferably under a force of about 1 lb. per inch, depending however, on the thickness of the film.

The tensional force on the film web can also be expressed as the force necessary to slightly stretch the film web so that when applying it around an article-loaded pallet, the film will not sag or otherwise lose its tautness. The main criterion of the superimposed wraps is that the surfaces of the superimposed film adhere together into a substantially monolithic structure due to the adherent characteristic of cling film.

The flexible cling film for use in this invention can be transparent, translucent or opaque depending on the properties of the articles being loaded. If light will affect the articles in any degree then the cling film should contain suitable additives to render it opaque while on the other hand, if it is advantageous to visually inspect the loaded articles, then a transparent cling film should be used.

The flexible cling film securing system of this invention can be utilized with various shaped loaded articles since the method of tightly stretching and concurrently applying the film about the articles will enable the film to adapt to the shape of the articles thereby providing a substantially uniform hoop tension to the articles. Thus cylindrical shaped articles, rectangular shaped articles, and other geometrically shaped articles can be securely retained on a pallet for storage or shipment. When desired, a sheet of cling film or any other suitable material may be placed on top of the article-loaded pallet so as to cooperate with the vertical cling film wraps to completely envelope the articles thereby protecting them from adverse environments.

Other features, additional objects, and many of the attendant advantages of this invention will readily become apparent from the following detailed description of the preferred embodiment when considered in conjunction with the drawing.

DETAILED DESCRIPTION

Figure 1:
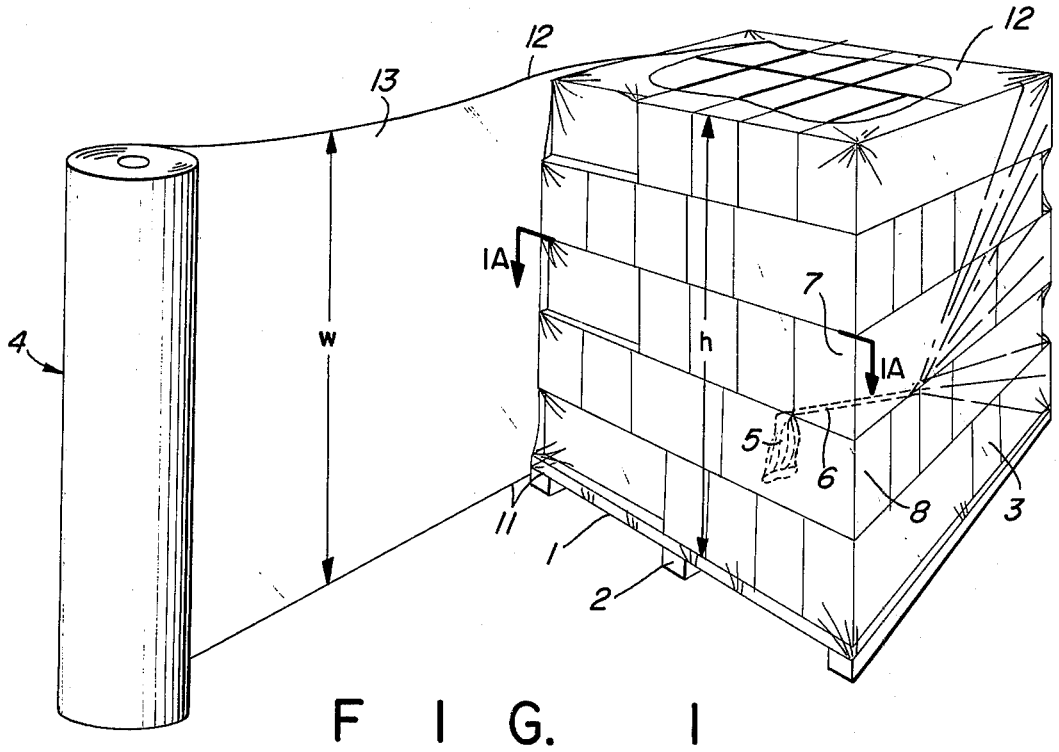
FIG. 1 is a perspective view of articles stacked on a pallet and vertically wrapped with a flexible cling film web according to this invention.
Figure 2:
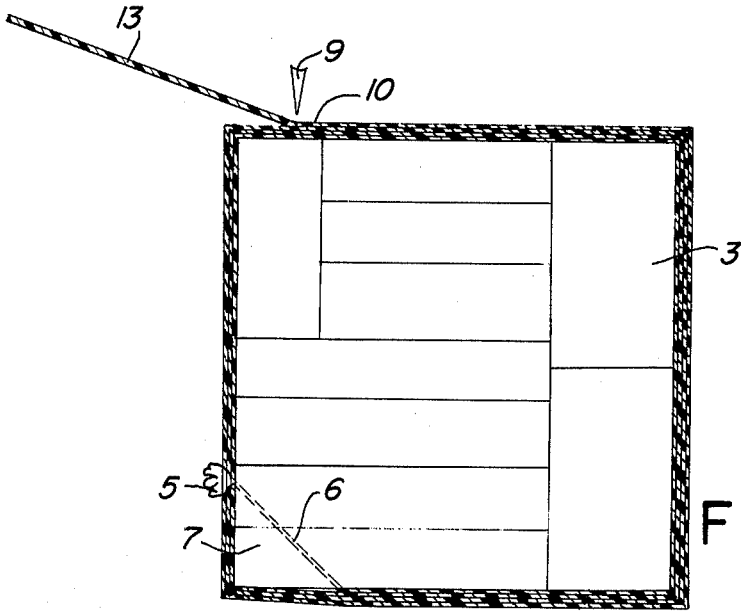
FIG. 2 is a sectional view taken along plane 1A—1A of the article-loaded pallet of FIG. 1.

In FIGS. 1 and 2 there is shown a load-supporting platform of a conventional pallet 1 held above a supporting floor by means of legs 2. The platform carries a stack of rectangular boxes 3 five layers high. The film strip or web 13 from a roll of flexible cling film 4, having a width "*w*" exceeding the height "*h*" of the loaded boxes 3, has its leading edge segment 5 twisted or crushed to form a compact rod-like segment 6 which is placed between the second and third layers of corner boxes 7 and 8. This is one way of securing leading edge 5 of cling web 13 to the stacked boxes.

After four layers of film web 13 have been tension wrapped around boxes 3, web 13 is cut by cutting means 9 and the trailing edge 10 is secured to the underlying wraps by applying a simple planishing pressure wipe. Thus the final wrap requires no additional adhesive, taping or heat sealing means to secure it to the underlying wraps. The flexible cling film web 13 thus provides a durable shipping enclosure for articles 3 loaded on pallet 1. As shown in FIG. 1, the bottom edge 11 of film web 13 can be secured to the platform of pallet 1 by means of a simple planishing pressure wipe while the top edge 12 can be stretched and secured to the peripheral edge of the uppermost layer of boxes 3. Although film web 13 is shown as a transparent film, it may be a translucent or opaque film as dictated by the requirements of articles loaded on the pallet or by the desires of the loader.

Figure 3:
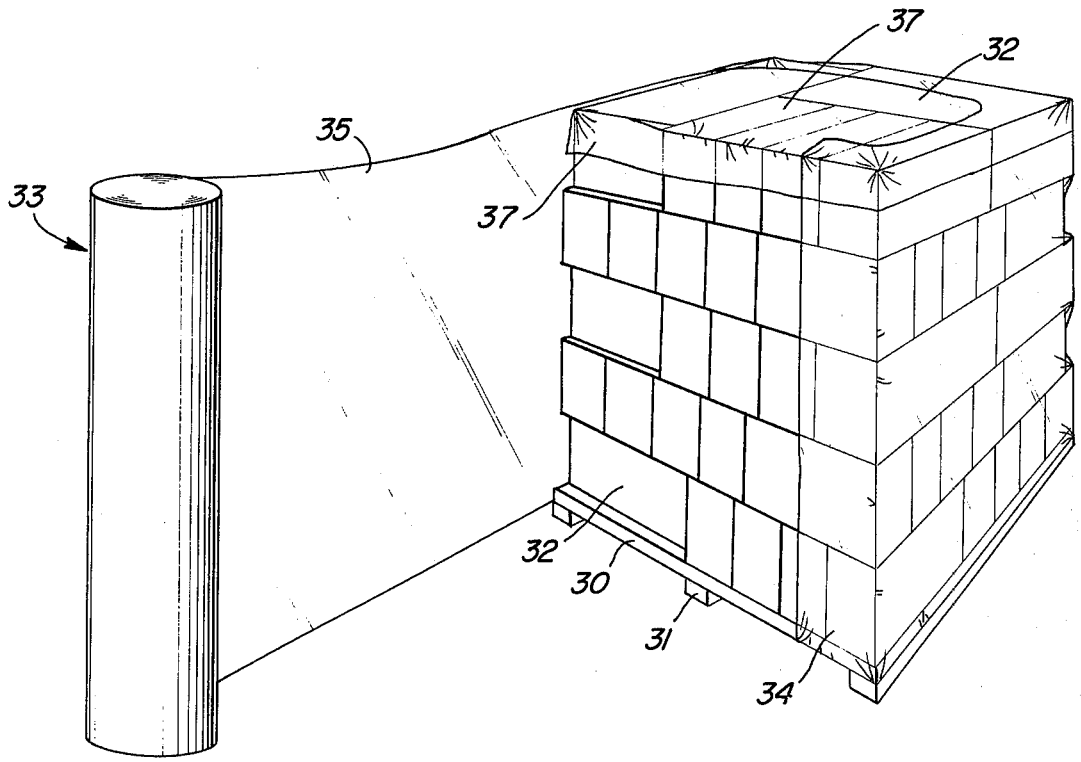
FIG. 3 is a perspective view of an article loaded pallet having a top covering and partially wrapped with a flexible cling film according to this invention.

FIG. 3 shows a load-supporting platform of a conventional pallet 30 held above a supporting floor by means of legs 31. The platform carries a stack of rectangular boxes 32 five layers high. A percut sheet of cling film 37 is positioned over the top layer of boxes 32 and secured thereat by applying a simple planishing pressure wipe. The film web 35 from a roll of flexible cling film 33 then has its leading edge area 34 vertically secured to the front surface of boxes 32. Thereafter, the film strip is tension wrapped around boxes 32 as described in conjunction with FIGS. 1 and 2. As also described in conjunction with FIGS. 1 and 2, cutting means are employed to sever the film web after the desired number of layers are achieved, then the trailing edge area of the film web is secured to the underlying wraps by applying a simple planishing pressure wipe. In the finalized film wrapped pallet, the cling film web in cooperation with the top sheet of the film completely envelopes the boxes thereby protecting them from dust, moisture and any other inclement elements that may be encountered during shipment or while in storage. Although the top sheet 37 is shown as a cling film, it is to be understood that any suitable sheet of material may be used to protect the surface of the top layer of boxes while they are being stored on a pallet. As can be seen from FIGS. 1 and 3, a box can be removed from the top layer of the pallet by simply cutting the film securing it and pulling it free. The free ends of the severed cling film can then be pressed down on the remaining boxes. Thus the removal of one or more boxes does not effect the securement of the remaining boxes whether they are located horizontally adjacent to or vertically adjacent to the removed box or boxes.

To facilitate the tension wrapping of flexible cling film about an article-loaded pallet, the pallet may be positioned on a turntable while the supply roll of film is held fixed. Upon activation of the turntable, the pallet will rotate whereupon the cling film web can be fed and wrapped about the pallet under a tensional force. By providing conventional braking means to a supply roll dispenser, and by regulating the speed at which the turntable rotates, the tension on the film web can be regulated as it is fed about the vertical outer periphery of the articles on the pallet. In addition, a brush or other semi-flexible vertical member may be positioned downstream of the feed of the film web and juxtaposed the outer periphery of the array of articles on the pallet, whereby it is adapted to impart a simple planishing pressure wipe to the film as it contacts and adheres to the outer peripheral surface of said array or to the underlying surface of the previous wrap.

EXAMPLE

Several pallets, similar to one shown in FIG. 1, were loaded with rectangular cases measuring 12 9/16 inches high, 12 ⅞ inches long and 8 ⅝ inches wide. The cases were stacked 4 layers high with 15 cases to each layer. A hand held dispenser, containing a 48-inch roll of 0.5 mil thick polyethylene cling film, obtained from Union Carbide Corporation, was used to feed cling film around the vertically outer periphery of the cases on each pallet. After 5 superimposed wraps were applied about each pallet, the film web was cut and the trailing edge was secured to the underlying wrap by using a simple planishing pressure wipe. The case-loaded pallets were then shipped by railroad from Ottawa, Ill. to a warehouse in Kansas City and upon inspection, the contents of the cases were found to have been only damaged to the extent of 0.03%. Thus the cling film securing system of this invention provides an economical and quick means for securing and protecting articles shipped on pallets.

Another embodiment within the teaching and scope of this invention is to use a cling film web having a width substantially less than the height of the array of articles which can be spirally wound around the array in such a manner so as to completely envelope the vertical outer periphery of said array with at least two substantially superimposed tensioned wraps of said film web.

It should be understood that the foregoing disclosure relates to preferred embodiments of the invention, and it is intended to cover all changes and modifications of the invention which do not depart from the spirit and scope of the appended claims.

What is claimed is:

1. An article-loaded pallet comprising a pallet supporting a plurality of articles in a predetermined array and having at least two substantially superimposed tensioned wraps of a flexible cling film web enveloping at least the vertical outer periphery of said array and said cling film being secured to the pallet thereby unitizing and securing said articles on said pallet within the tensioned wrapped adhered surfaces of the superimposed layers of the cling film web and wherein the surface of each layer of said cling film web has a cling energy of between about 0.15 and about 0.4 cm-gm, said cling energy being the energy in cm-gms required to peel a 3 ½ inch wide by 4 inch long cling film specimen from a glass plate when using the test procedure outlined in ASTM D903=49, titled "Test For Peel Strengths Of Adhesives".

2. The article-loaded pallet of claim 1 wherein the flexible cling film is between about 0.25 mil and about 1.25 mils thick.

3. The article-loaded pallet of claim 1 wherein a sheet of material is placed over the top layer of the array.

4. The article-loaded pallet of claim 1 wherein said cling film has a width substantially at least the height of the array.

5. The article-loaded pallet of claim 4 wherein the flexible cling film is between about 0.25 mil and about 1.25 mils thick.

6. The article-loaded pallet of claim 4 wherein a sheet of material is placed over the top layer of the array.

7. The article-loaded pallet of claim 5 wherein about four superimposed wraps of the flexible cling film envelope the outer periphery of the array.

8. The article-loaded pallet of claim 1 wherein the cling film web has a width equal to at least the height of the articles loaded on the pallet.

9. The article-loaded pallet of claim 1 wherein the cling film web has a width substantially less than the height of the articles loaded on the pallet and wherein said cling film web is spirally wound around the articles in a manner so as to completely envelop the vertical outer periphery of the articles.

* * * * *